US005140921A

United States Patent [19]

Howlett

[11] Patent Number: 5,140,921

[45] Date of Patent: Aug. 25, 1992

[54] MAST PROVIDED WITH GUIDE MEANS FOR HALYARDS

[76] Inventor: Ian C. Howlett, Chestnut Cottage, Beaulieu, Hampshire SO42 7YB, England

[21] Appl. No.: 779,956

[22] Filed: Oct. 21, 1991

[30] Foreign Application Priority Data

Oct. 30, 1990 [GB] United Kingdom ..... 9023665

[51] Int. Cl.[5] ..... B63B 15/00

[52] U.S. Cl. ..... 114/90; 114/112; 114/39.1

[58] Field of Search ..... 114/39.1, 89, 90, 112, 114/102, 103, 108, 109; 52/720, 735

[56] References Cited

U.S. PATENT DOCUMENTS 3,814,835 6/1974 Merry ..... 114/90

4,072,121 2/1978 Anderson et al. ..... 114/90

FOREIGN PATENT DOCUMENTS 2037686 7/1980 United Kingdom ..... 114/90

*Primary Examiner*—Edwin L. Swinehart

*Attorney, Agent, or Firm*—Notaro & Michalos

[57] ABSTRACT

With reference to FIG. 2, a mast (10) for a sailing vessel is provided with a guide (25) for guiding halyards (19) along the mast and for maintaining the halyards in spaced apart relationship.

The guide (25) comprises a track (13) for sail slides and batten cams, extending longitudinally of the mast (10), a track support (11) of elongate form located between the track (13) and the mast (10), and a plurality of longitudinally spaced apart guides (14) located between the track (13) and the mast (10), the guides each being provided with a plurality of spaced apart apertures (17) through which the halyards (19) extend.

5 Claims, 1 Drawing Sheet

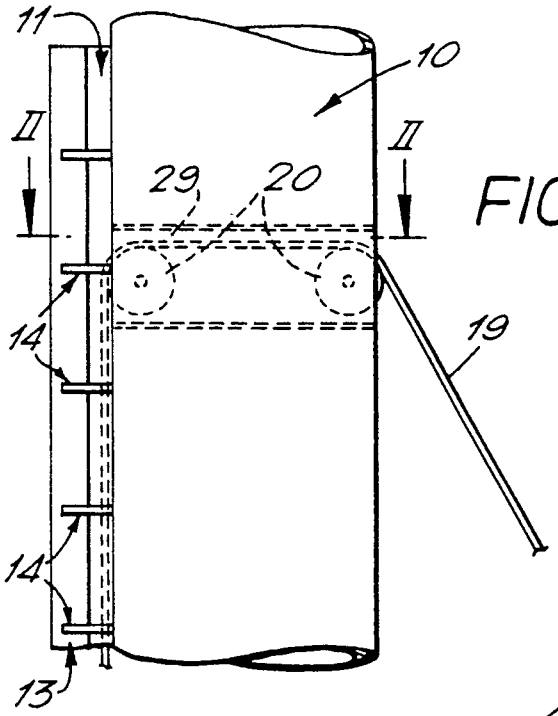
FIG.1.
FIG.2.
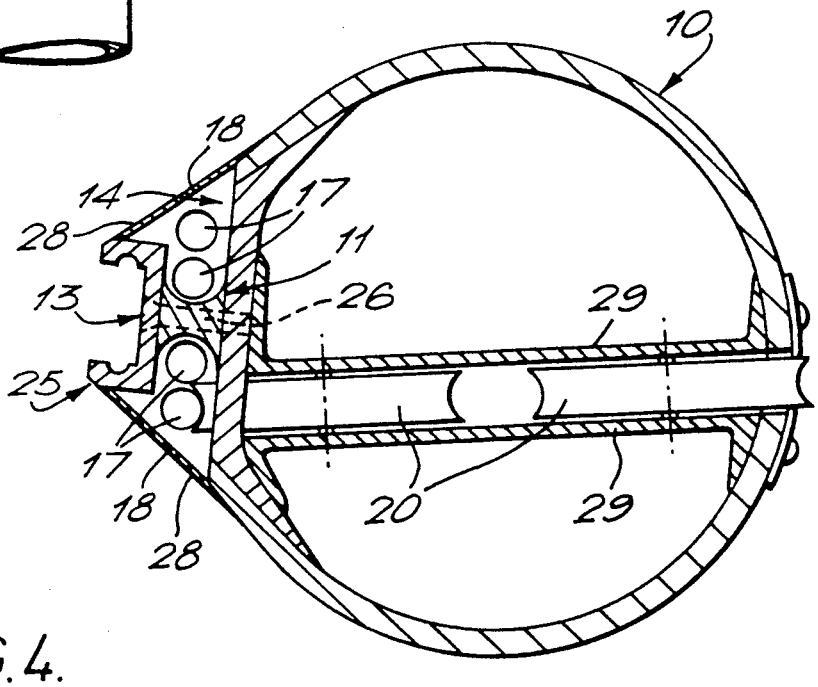
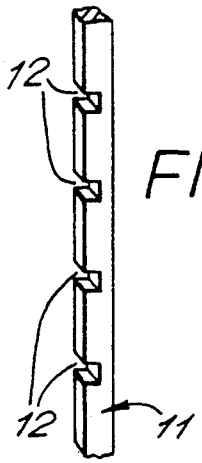
FIG.4.
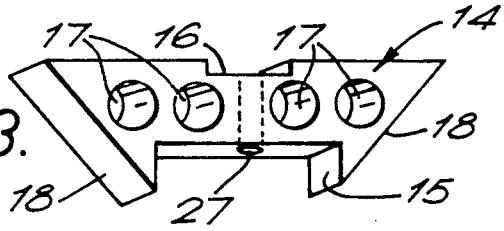
FIG.3.

MAST PROVIDED WITH GUIDE MEANS FOR HALYARDS

BACKGROUND OF THE INVENTION

This invention relates to a mast for a sailing vessel provided with means for guiding halyards along the mast.

Halyards are used on sailing vessels for hoisting and lowering a sail or other members along a mast and on sailing vessels having, for example, a mainsail, a Genoa sail and a jib sail, a plurality of halyards are provided which extend along the mast and which can become entangled one with another. When the halyards extend along the exterior of the mast they tend to strike against the mast when loose, creating noise and can damage the surface finish of the mast.

On sailing vessels having a hollow mast it is known to provide guide conduits within the mast through which the halyards extend and which keep the halyards separated so that they do not become entangled. However, such conduits tend to wear and if a halyard breaks and requires to be replaced, it is difficult to gain access to the broken halyard and it is difficult to replace the broken halyard with another one.

SUMMARY OF THE INVENTION

According to the present invention there is provided a mast for a sailing vessel provided with means for guiding halyards along the mast and for maintaining them in spaced apart relationship, comprising a track for sail slides extending longitudinally of the mast, a track support located between the track and the mast and a plurality of spaced apart guides located between the track and the mast, said guides each being provided with a plurality of apertures through which the halyards are intended to extend.

Preferably the guides are provided on their rear side with a notch which receives the track support and the track support is provided with a plurality of spaced apart notches each of which receives a guide. Thus, the guides are located relative to the track support.

The guides may support at their side edges fairings which extend between the mast and the track and which serve to close off the space in which the halyards are received.

BRIEF DESCRIPTION OF THE DRAWINGS

An embodiment of the invention will now be described, by way of an example only, with reference to the accompanying drawings, wherein:

FIG. 1 is a side elevation of part of a mast embodying the present invention;

FIG. 2 is a cross-section through the mast taken along the line II—II indicated on FIG. 1;

FIG. 3 is a perspective view of a guide member; and

FIG. 4 is a perspective view of part of the track support.

DETAILED DESCRIPTION OF THE PREFERRED EMBODIMENT

A mast 10 for a sailing vessel is shown in the drawings as being hollow but it may be solid. The mast 10 is provided with external means 25 for guiding halyards 19 along the mast and for maintaining the halyards in spaced apart relationship.

The guiding means 25 comprise an elongate track 13 for sail slides and batten cams, (not shown), extending longitudinally of the mast 10, a track support 11 of elongate form located between the track 13 and the mast 10, and a plurality of longitudinally spaced apart guides 14 located between the track 13 and the mast 10, the guides each being provided with a plurality of spaced apart apertures 17 through which the halyards 19 extend.

The track 13 and track support 11 are secured to the mast 10 by bolts 26 (FIG. 2) located by holes 27 (FIG. 3) formed in the guides 14. The track support 11 is formed with a plurality of longitudinally spaced apart notches 12 (FIG. 4).

Each guide 14 is formed on its rear side with a recess or notch 15 in which the track 13 is received and a recess or notch 16 which receives the support 11. Each guide 14 is engaged with one of the notches 12 in the support 11 and thus the notches 12 serve to locate the guides 14 longitudinally of the support 11 whereby the four apertures 17 of one guide 14 are aligned with the corresponding apertures of the other guides. The side edges 18 of each guide 14 are inclined.

Each halyard 19 extends through a respective one of the apertures 17 in each guide 14 and passes over sheaves or pulleys 20 mounted on supports 29 for rotation within the mast 10 and is fastened to the upper end of the respective sail.

Fairings 28 are secured to the inclined side edges 18 of the guides 14 so as to extend between the mast 10 and the track 13 and close off the space in which the halyards 19 are received. These fairings are optional.

The guides 14 may be formed of any suitable material, but are preferably formed of plastics material, or metal, or wood.

Preferably the guides 14 are 15 mm thick and spaced 300 mm apart.

In order to reduce wear, the apertures 17 may be lined with a wear resistant material.

The mast 10 may be formed of wood, or aluminum, or of a suitable plastics material.

It is possible for the guides 14 to form an integral part of the track 13.

The track 13 and support 11 may be formed integrally. Alternatively, the track 13 and support 11 may be formed integrally together with the back portion of the mast 10. The guides 14 may then be formed in two separate pieces placed one on each side of the support 11.

It is possible for the guides 14 to be formed integral with the track 13 and support 11.

The guides 14, instead of being in the plate form illustrated, may be of other form. For example, they may be formed of stainless steel strip material or of wire.

The invention achieves the advantages of an external track while avoiding windage penalties normally associated therewith.

I claim:

1. A mast for a sailing vessel, provided with means for guiding halyards along the mast and for maintaining them in spaced apart relationship, said means comprising a track for sail slides extending longitudinally of the mast, a track support located between the track and the mast and a plurality of spaced apart guides located between the track and the mast, said guides each being provided with a plurality of apertures through which the halyards are intended to extend.

2. A mast as claimed in claim 1, wherein the guides each are formed with a notch which receives the track support, and the track support is provided with a plurality of spaced apart notches each of which receives a guide.

3. A mast as claimed in claim 1, provided with fairings extending between the mast and the track.

4. A mast as claimed in claim 3, wherein said fairings are secured to said guides.

5. A mast as claimed in claim 1, wherein said mast is of hollow form, and is provided with pulleys for the halyards, which pulleys are mounted within the mast.

* * * * *